United States Patent [19]

Bourdeau et al.

[11] Patent Number: 4,868,927

[45] Date of Patent: Sep. 26, 1989

[54] GLOVES

[75] Inventors: Joel Bourdeau, Saint Jorioz; Georges P. J. Salomon, Seynod, both of France

[73] Assignee: Salomon S.A., Annecy Cedex, France

[21] Appl. No.: 160,323

[22] Filed: Feb. 25, 1988

[30] Foreign Application Priority Data

Feb. 26, 1987 [FR] France ..... 87 02881

[51] Int. Cl.[4] ..... A41D 13/10; A41D 19/00; A41D 19/01

[52] U.S. Cl. ..... 2/161 A; 2/158; 2/159; 2/162; 2/311

[58] Field of Search ..... 2/159, 161 R, 161 A, 2/162, 256, 311; 36/50

[56] References Cited

U.S. PATENT DOCUMENTS

| | | | |
|---|---|---|---|
| 588,426 | 8/1897 | Harloe | 2/162 |
| 689,558 | 12/1901 | Meyers | 2/162 X |
| 752,769 | 2/1904 | Graichen | 2/162 |
| 924,545 | 6/1909 | Emmert | 02/162 X |
| 1,748,833 | 2/1930 | Dunne | 2/162 X |
| 1,981,779 | 11/1934 | Chanut | 2/162 |
| 4,099,270 | 7/1978 | Jabour | 2/168 |

FOREIGN PATENT DOCUMENTS

| | | | |
|---|---|---|---|
| 0519131 | 2/1931 | Fed. Rep. of Germany . | |
| 0040381 | 12/1986 | Fed. Rep. of Germany . | |
| 418800 | 12/1910 | France . | |
| 426108 | 3/1935 | United Kingdom | 2/159 |

OTHER PUBLICATIONS

*Journal of American Medical Association,* vol. 168, No. 7, Oct. 19, 1958, p. 930, Gershman, M., "Self Adhering Nylon Tapes".

*Primary Examiner*—Werner H. Schroeder
*Assistant Examiner*—Sara M. Current
*Attorney, Agent, or Firm*—Sandler & Greenblum

[57] ABSTRACT

An article of clothing adapted to receive at least a portion of a wearer's body, having a rear end forming an access passage for the wearer's hand and at least one elastic member so disposed as to bias the access passage towards a substantially open position. The article of clothing, which may be in the form of a glove or mitten, may also include an opening extending substantially longitudinally forward from the rear end. A closure device, such as a zipper, may be adjacent the opening and may be selectively operated to urge the opening, and thus the access passage, towards a substantially closed position, sealing the article of clothing against the wearer's wrist or forearm.

54 Claims, 9 Drawing Sheets

FIG 1
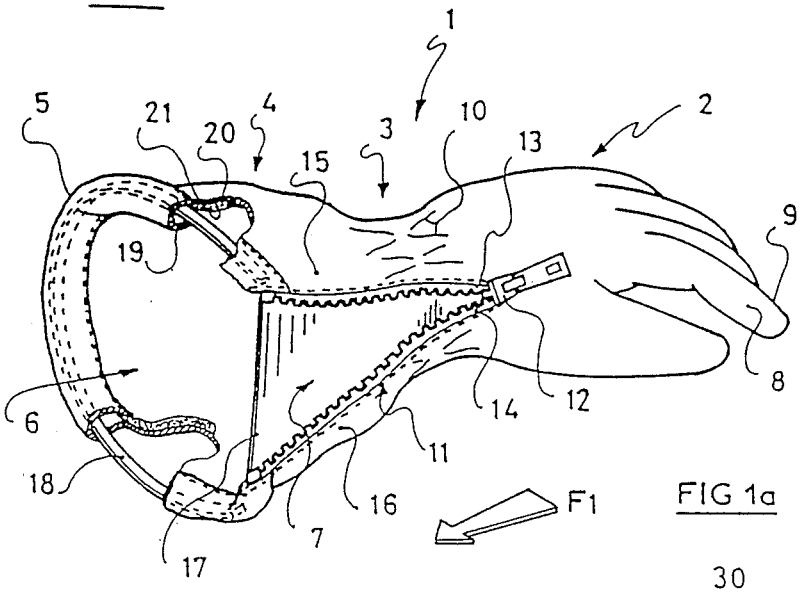
FIG 1a
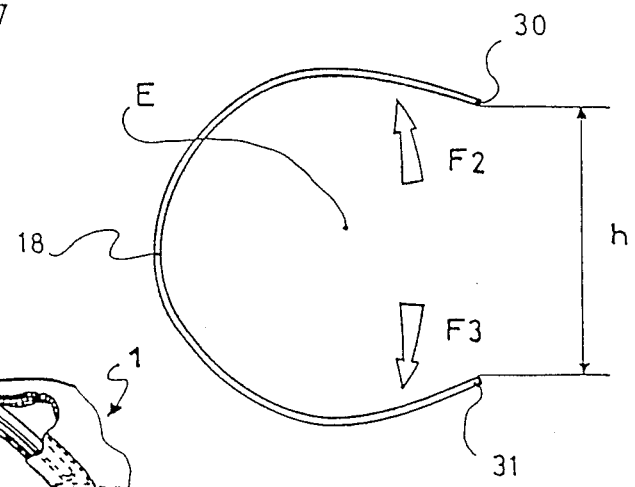
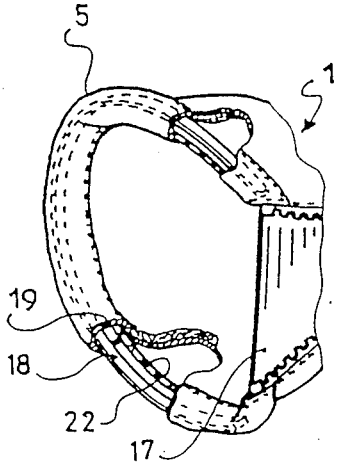
FIG 1b

FIG 3a
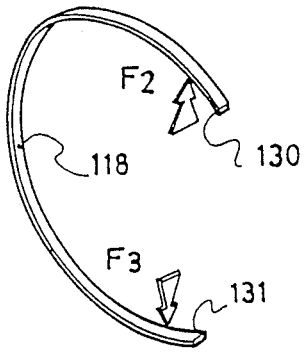
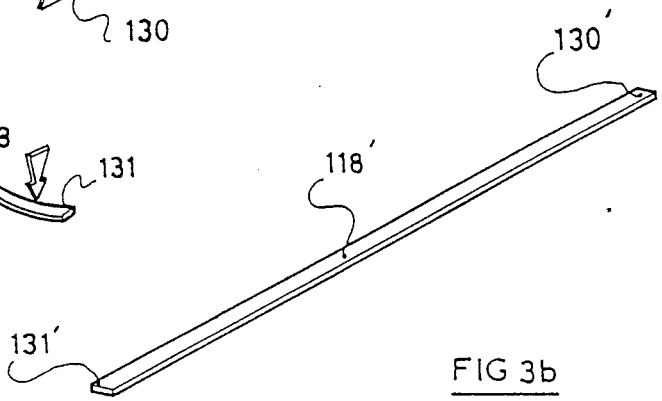
FIG 3b
FIG 3c
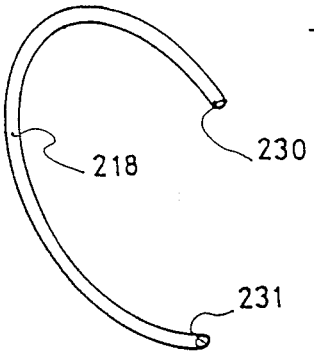
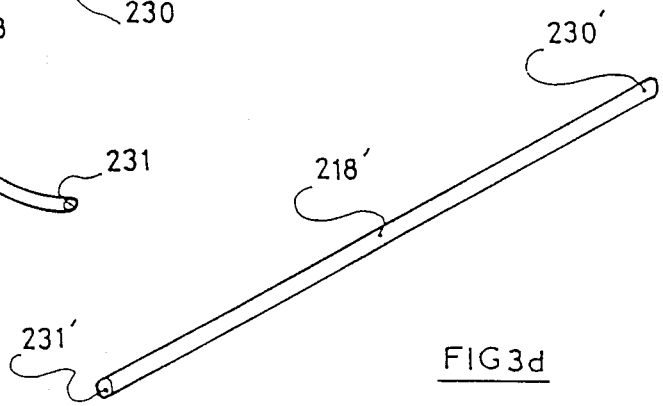
FIG 3d

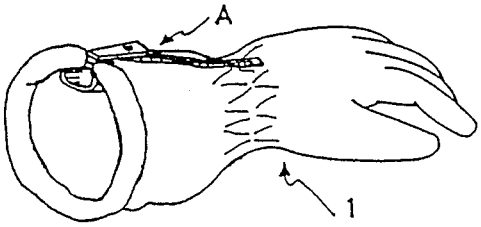
FIG 10a
FIG 10b
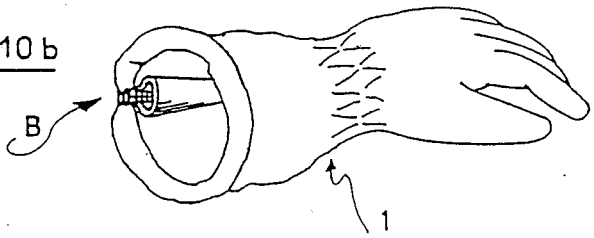
FIG 10c
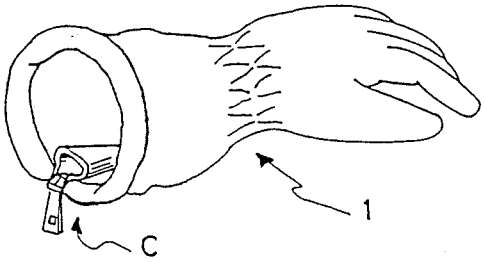
FIG 11
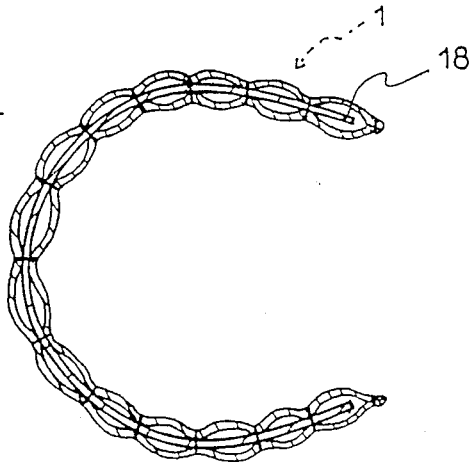

GLOVES

BACKGROUND OF THE INVENTION

1. Field of the Invention

The present invention relates to articles of clothing adapted to the hand, such as gloves, mittens, or the like, and more particularly to sports gloves.

2. Description of Background and Relevant Information

The term "glove" will be used in the present application to designate the above-described pieces of clothing only for purposes of simplicity, and is not intended to limit the present application specifically to gloves.

The sports gloves in question are most particularly utilized in winter sports, such as skiing.

It has been noted that the prior art in this field tends to improve functions such as protection against shocks, insulation, and improvement of the grip, without ever dealing with the disadvantages relating to the difficulty of access of the hand and of a portion of the forearm to the glove. One observes that, by virtue of the tightness of the access opening of the glove, it is difficult to engage the hand on the interior without adjusting the sleeves of the clothing, leading to a disturbance of insulation, and thus of comfort.

There exist gloves provided with a lateral zipper which makes it possible to increase the access passage of the hand in the glove. However, by virtue of the flexible structure of the glove, the glove tends to collapse upon itself. Thus, the sought-after effect occurs to only a small extent. Consequently, one encounters difficulties in engaging the hand and the forearm, especially when covered with a clothing sleeve, within the glove. The sleeve is pushed up or inserts poorly in the glove. This results in deficiencies in the insulation and sealing of the glove. On the other hand, comfort for the user is not assured. Furthermore, in this type of glove the lack of grip, and thus of opening, complicates the aeration and drying operations.

Gloves or the like are also known which cover a portion of the forearm by means of a sleeve, and which comprise at their rear portion elastic means which press the rear portion at the level of the access passage around the forearm. In this arrangement, the above disadvantages are amplified. It is thus necessary to make numerous awkward manipulations with the free hand to slide on the glove, with even more difficulties when the free hand is already covered with a glove.

It is clear that the state of the art does not present satisfactory solutions for resolving the problems posed.

SUMMARY OF THE INVENTION

The present invention is directed to an article of clothing adapted to protect at least a portion of a wearer's body from the ambient environment. The article of clothing includes a rear end comprising an access passage adapted to receive a wearer's hand, and a first elastic member, positioned adjacent the rear end, comprising first biasing means for biasing the access passage into a substantially open position.

The article of clothing may further include closure means for selectively urging the access passage into a substantially closed position in which the hand is substantially sealed from the ambient environment. These closure means may comprise means for closing an opening in the article of clothing extending substantially longitudinally forwardly from the rear end.

The article of clothing may further comprise a first cavity adapted to receive a thumb and at least one second cavity adapted to receive at least one finger, the second cavity being positioned substantially adjacent the first cavity and having an exterior side facing the first cavity, wherein the opening in the article of clothing is substantially positioned along a line which is substantially colinear with the exterior side.

The article of clothing may be in the form of a glove or mitten further comprising a dorsal surface, a ventral surface, and a lateral surface adjacent the dorsal and ventral surfaces, wherein the opening is positioned substantially along the dorsal surface, the lateral surface, or the ventral surface.

The opening in the article of clothing may comprise first and second edges, and the first biasing means may comprise an elastic member, which may have a substantially triangular configuration. This elastic member may comprise first and second arms which form an oblique angle therebetween, and the arms may be positioned within enclosed channels of the article of clothing, wherein the enclosed channels are positioned substantially adjacent the first and second edges.

The opening may additionally comprise first and second edges, and the closure means may comprise means for selectively joining the first and second edges, such as a zipper, Velcro, a snap, or a loop-and-button type closure.

The first and second edges may comprise first and second edge ends located substantially at the rear end, and the elastic member my comprise first and second member ends located substantially adjacent the edge ends, the article of clothing further comprising means for affixing at least one of the member ends to at least one of the edge ends. These means for affixing may comprise a flexible elastic element having a first element end which is affixed to one of the member ends and a second element end which is affixed to one of the edge ends.

The article of clothing may also comprise a gusset extending between the first and second edges, and the gusset may be affixed substantially adjacent the first and second edges. The gusset, which may have a substantially triangular shape, is preferably substantially fully extended between the first and second edges when the access passage is in the substantially open position.

Said closure means may be movable between an operational position in which the access passage is in the substantially closed position and a non-operational position in which the access passage is in the substantially open position.

The access passage in the article of clothing comprises a periphery that is substantially circular in the substantially closed position and substantially arcuate in the substantially open position. The elastic member may include a first elastic band extending along at least a portion of the periphery, and this elastic band may be positioned within an enclosed channel in the article of clothing.

The first elastic band may have a substantially rectangular cross-section, or a substantially circular cross-section. Moreover, the first elastic band may either be substantially linear prior to insertion into the article of clothing and have a substantially circular curvature following insertion; or, the first elastic band may have a substantially circular curvature prior to insertion into the article of clothing.

The first elastic band may include first and second ends spaced apart by a distance of between about 5 and 20 cm when the access passage is in the substantially open position, and may be composed of a substances such as polyamide-type materials, polyethers, Hytrel, and metals.

In one particular embodiment the first elastic band may comprise a flexible shell extending longitudinally forwardly from the rear end. In another embodiment, the first elastic band may have a generally curvilinear shape comprising a plurality of sections that are oppositely angled with respect to each other when the access passage is in the substantially open position. In this embodiment the first elastic band is urged into a substantially continuous curve when the access passage is in the substantially closed position.

The article of clothing according to the present invention may include a third elastic band extending substantially both parallel to and adjacent the first elastic band. This third elastic band comprises means for biasing the access passage towards the substantially closed position with a lesser biasing force than the first elastic member. The first and third elastic bands may be enclosed within a single channel of the article of clothing.

In yet another embodiment, the article of clothing according to the present invention may include a second elastic band, which may be shorter than the first elastic band, and which extends transversely along at least a portion of the article of clothing at a location spaced apart from the first elastic band. This second elastic band comprises a second elastic member which comprises means for biasing the access passage towards the substantially open position. In this embodiment, the first and second elastic bands may each be positioned within an enclosed channel of the article of clothing.

The article of clothing according to the present invention may include a cuff portion, a wrist portion, and a hand portion, such that the cuff portion extends from the rear end forwardly towards the wrist portion, the wrist portion extends from the cuff portion forwardly to the hand portion, and the hand portion extends forwardly from the wrist portion to a front end, wherein the second elastic band is located substantially along the wrist portion.

The article of clothing according to the present invention may more particularly comprise a mitten, which may have a first cavity adapted to receive a thumb and a second cavity adapted to receive the remaining digits of the hand. Alternatively, the article of clothing may comprise a glove, which may comprise a plurality of cavities each adapted to receive one digit, or which may comprise a first cavity adapted to receive a thumb, a second cavity adapted to receive an index finger, and a third cavity adapted to receive a middle, ring, and index finger.

In another embodiment, the article of clothing according to the present invention is adapted to cover a portion of the hand of a wearer extending from the fingers to at least the wrist area of the wearer. The article of clothing comprises an access passage adapted to receive the hand, elastic means for biasing the access passage into a substantially open position, and closure means for selectively urging the access passage into a substantially closed position. These closure means may be, for example, in the form of a zipper, Velcro, or pressure button type closure.

In this embodiment the article of clothing may be characterized as comprising a rear end and a wrist zone, wherein the elastic means comprise an elastic element comprising at least one flexible arc positioned substantially between the rear end and the wrist zone.

In one variation of this embodiment, the article of clothing is adapted to cover a portion of the user's hand extending from the user's finger area to substantially the user's wrist area, while in another variation the article of clothing may further comprise a cuff portion adapted to cover a portion of the user's hand extending from the user's wrist area rearwardly towards the user's forearm area.

The elastic means may comprise an elastic element constituted by at least one flexible arc, which may be enclosed in a channel provided in the article of clothing. This channel may border the access passage.

In one particular embodiment, the flexible arc may be affixed to at least one layer of material used to form the article of clothing.

The article of clothing may further include an opening positioned substantially longitudinally along the article of clothing and comprising first and second edges, and the elastic band may comprise a substantially V-shaped elastic element comprising two arms, each of the arms being positioned parallel to one of the edges.

In a preferred embodiment the closure means are movable between a first, non-operational position and a second, operational position, such that the access passage has a cross-sectional area greater than the cross-sectional area of the wrist area when the closure means are in the non-operational position .

The article of clothing be in the form of a glove or mitten, such that the access passage comprises a first lateral side comprising a thumb enclosure, a dorsal side adjacent the first lateral side, a second lateral side adjacent the dorsal side, and a ventral side adjacent both the second lateral side and the first lateral side. The opening may accordingly be positioned substantially in the first lateral side, the dorsal side, the second lateral side, or the ventral side.

The opening may also be characterized as being positioned substantially longitudinally along the article of clothing and as having an open position corresponding to the non-operational position and a closed position corresponding to the operational position.

The elastic means of the article of clothing may comprise an elastic element having substantially circular curvature and comprising two free ends. These two free ends may be separated by a distance h when the closure means are in the non-operational position and by a distance $h_1$ when the closure means are in the operational position, with distance h being greater than distance $h_1$.

The opening may also comprise first and second edges and at least one additional elastic element affixed to one of the first and second edges, wherein at least one of the two free ends of the elastic element is affixed to the at least one additional elastic element.

The elastic element may comprise a shell extending forwardly from the opening of the access passage.

The article of clothing according to the present invention may be substantially in the form of a mitten, which may include first and second edges of the opening and a gusset sealing the opening, such that the dimensions of the gusset correspond to distance h.

The flexible arc previously described may be positioned substantially around the access passage to provide access for the hand, and may have a cross-section which is substantially circular, or which is substantially rectangular. Moreover, the flexible arc may have a precurved shape, which establishes the maximum diameter of the access passage, or may have a be substantially rectilinear shape prior to insertion into the article of clothing. Finally, the flexible arc may comprise a plurality of oppositely-angled curves.

BRIEF DESCRIPTION OF THE DRAWINGS

The invention will now be described with reference to certain non-limiting examples of various embodiments of the present invention, and by reference to the annexed drawings in which:

FIG. 1 illustrates a rear perspective view of a glove according to the invention, in the open position. The FIG. also includes a partial cut-away with respect to the rear end of the glove.

FIG. 1*a* illustrates a view of the elastic arc shown in FIG. 1.

FIG. 1*b* illustrates a partial cut-away according to FIG. 1, with a modification of construction.

FIG. 2 also includes a partial cut-away with respect to the rear end of the glove.

FIG. 3*a* illustrates a perspective view of a first embodiment of the elastic element according to the invention;

FIG. 3*b* illustrates a perspective view of a second embodiment of the elastic element according to the invention;

FIG. 3*c* illustrates a perspective view of a third embodiment of the elastic element according to the invention;

FIG. 3*d* illustrates a perspective view of a fourth embodiment of the elastic element according to the invention;

FIGS. 10*a*, 10*b*, and 10*c* illustrate examples of positioning the lateral opening for a glove according to the invention;

FIG. 11 illustrates one way of affixing the flexible arc to a glove according to the invention;

DESCRIPTION OF PREFERRED EMBODIMENTS

Figure 2:
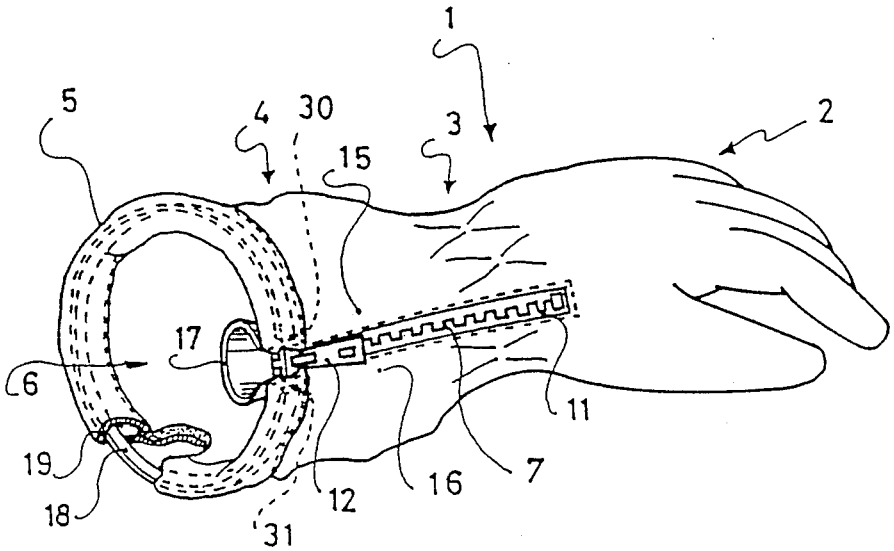
FIG. 2 illustrates a rear perspective view of a glove according to the invention in the closed position.

According to the present invention, in order to overcome the disadvantages noted above an article of clothing is provided which adapts to the hand and which covers it at least up to the wrist, such as a glove, mitten or the like, comprising closure means as well as an access passage for the hand, characterized in that it comprises:

elastic means for maintaining the access passage for the hand to the article of clothing in a substantially open position.

A glove according to the present invention thus has the advantage of offering an access passage which is substantially open, allowing for introduction of the hand and of the forearm into the glove in a convenient manner. The operation of sliding on the glove can occur without requiring a readjustment of the sleeve or other clothing towards the upper portion of the arm. Furthermore, whatever orientation in which one places the glove in the open position after use, drying and aeration of the glove occur in a perfectly correct manner by virtue of the constant maintenance of the glove in the substantially open position.

The present invention relates thus to an article of clothing, particularly a glove, comprising an opening cooperating with a closure positioned substantially longitudinally; an access passage for the hand at the rear end of the glove; and, an arc of elastic material having a substantially circular shape and two free ends, the arc being positioned along the periphery of the access passage. The two free ends are adjacent to the rear limits of the edges of the opening.

In the non-operational position of the closure, i.e., when the two edges of the opening are not affixed to one another, the elasticity of the arc tends to maintain the two free ends at a given distance, defined either by the precurvature given initially to the flexible arc, or by the displacement limits conferred to the arc by the glove. The glove will thus have, in the non-operational position of the closure, a substantially open access passage of sufficiently substantial dimensions to facilitate entry of the hand. In the operational position of the closure, in which the two edges of the opening are affixed to one another, the dimensions of the access passage are reduced so as to apply the glove against the hand and/or forearm.

According to other characteristics of the invention, the elastic means according to the present invention can be present in the form of an arc having a general shape constituted by a succession of curves, or the elastic means can be composed, in part, of elastic elements extending in the longitudinal direction with respect to the means. According to another embodiment of the invention, the elastic means can be in the form of one or more arcs of the same type, localized in the zone defined by the region of the wrist and the rear end of the glove, or furthermore they can consist of a flexible shell of the same general crosssectional shape as the above arc, this shell functioning on the same principal and being localized in the same zone as the arcs, while conferring moreover to the glove a protective function against shocks to the wrist and forearm of the user.

Furthermore, the glove according to the invention can comprise a channel between the edges of the longitudinal opening.

According to another characteristic of the invention, the elastic elements can have an initial shape, before assembly, which is substantially rectilinear or furthermore a pre-curved shape.

Referring to FIG. 1, an article of clothing and more particularly a glove 1 is shown which is adapted to cover the hand. Glove 1 has a zone 2 adapted to cover the hand and extending to wrist 3, as well as a zone 4 denominated a cuff, extending along the forearm. The glove 1 illustrated by way of example in FIG. 1 also comprises a rear end 5 bordering access passage 6 for access of the hand into glove 1.

A longitudinal opening 7 is provided laterally in glove 1 and extends from the direction of edge 8 of index finger 9, into a zone which has as a limit rear end 5 of glove 1. Zone 3 of the wrist is equipped, in a known manner, with an elastic bracelet sewn with glove 1. This elastic bracelet, of which one can see maintenance stitches 10 in FIG. 1, allows for pressing, and thus adaptation, of the glove on the wrist.

Opening 7 is provided with closure means which can in particular be a zipper 11. Closure 11 is maneuverable by means of a sliding piece 12, and the two portions 13 and 14 which constitute it are connected by stitching to the two edges 15 and 16 of opening 7.

In the non-operational position of closure 11, sliding piece 12 is in a front extreme position of glove 1, i.e., towards the fingers. The longitudinal opening 7 is thus disengaged because the two edges 15 and 16 are not affixed to one another.

In the operational position of closure 11, the sliding piece is moved to its maximum position along Fl towards the rear of glove 1, situated at the rear end 5 of glove 1. Longitudinal opening 7 is thus closed because the two edges 15 and 16 are affixed to one another as shown in FIG. 2.

Additional examples of closure means which may be used are a "VELCRO" (a registered trademark) type closure, or any closure of the "pressure button" or snap type, button-and-eyelet type, etc. These alternative closure means are affixed to the article of clothing in a conventional manner not requiring further description here.

In order to insulate the interior of the glove with respect to the ambient environment, as well as to limit the possibility of movement of longitudinal opening 7, there is provided a piece of material called a gusset (17). Web 17 is sewn to the two edges 15 and 16 of opening 7. One of ordinary skill in the art will sufficiently recognize the gusset such that it is not necessary to further amplify on the description of this feature.

In the embodiment illustrated in FIG. 1, the elastic means according to the invention is positioned substantially at the rear end 5 of glove 1. There is in effect an elastic element or flexible arc 18 positioned in channel 19 defining the limits of access passage 6 for insertion of the hand in glove 1. In the partial cut-aways of FIG. 1, one can clearly see elastic arc 18 which is inserted within channel 19. The channel 19 is constituted by an exterior envelope fold 20, which is impermeable and insulates glove 1. Exterior envelope fold 20 is positioned around an insulating material 21.

Channel 19 extends along the periphery of glove 1 substantially from edge 15 to edge 16 of opening 17.

Elastic arc 18 is inserted in this opening and, by virtue of its elasticity, has a tendency to maintain open, along F2 and F3, the access passage 6 for inserting the hand in glove 1.

Elastic arc 18 in rear view, in the position that it occupies in FIG. 1, is shown in FIG. 1*a*. One can see that it is an element of substantially circular curvature having free ends 30 and 31. Under the elastic force of the material, in the position that arc 18 occupies in FIG. 1, the ends 30 and 31 are separated by a distance h which defines the limits of opening of glove 1.

According to a principle of the invention, the distance h must correspond to the dimensions of the perimeter of access passage 6, which are at least equal to those of the forearm of the user covered by clothing.

Thus, in the non-operational position of the closure means 11, the space E generated by flexible arc 18 for access passage 6 makes it possible to slide the hand and forearm into the glove in a very easy fashion. On the other hand, maintenance of access passage 6 in the open position allows for perfect aeration of the glove after use.

FIG. 2 illustrates a glove according to the invention in the operational position of closure means 11.

Figure 2A:
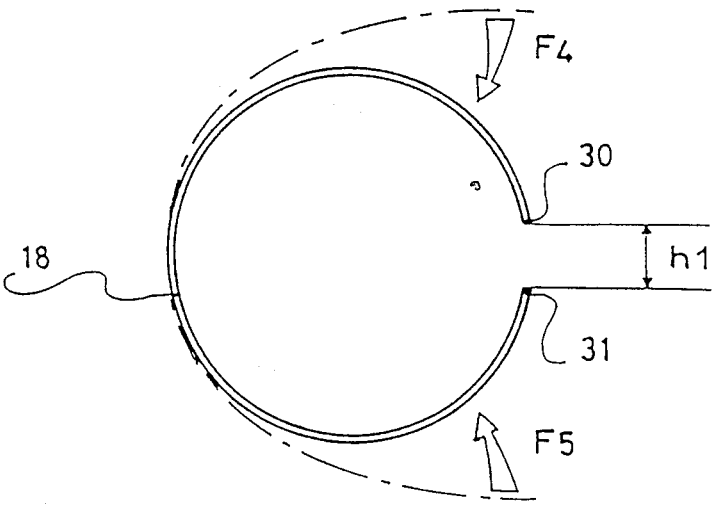
FIG. 2*a* illustrates a view of the elastic arc in the situation of FIG. 2.

Under the force exerted along F4 and F5 by zipper closure 11 which affixes the two edges 15 and 16 of longitudinal opening 7, the flexible arc 18, as shown in FIG. 2*a*, assumes a more nearly circular shape than in FIG. 1*a*. The distance $h_1$ separating free ends 30 and 31 of flexible arc 18 is thus considerably less than the distance h which exists in the situation shown by FIG. 1. This difference between $h_1$ and h expresses one of the essential characteristics of the invention which results in an increase of the extent of the opening of access passage 6 of glove 1.

One can thus note that flexible arc 18 according to the invention is involved in at least two distinct positions. The first of these positions is illustrated by FIGS. 1 and 1*a*, in which arc 18 occupies an active position because, within the limit of the stresses which are imposed by the seat which contains it, thus by channel 19, the elasticity which composes the arc makes it possible for the arc to increase the access passage by transforming the distance $h_1$ between free ends 30 and 31 of arc 18 into a distance h which is greater than $h_1$.

This distance $h_1$ is relevant to the second position of flexible arc 18 as illustrated in FIGS. 2 and 2*a*. Arc 18 occupies this time an inactive position. In effect, its elastic property does not express itself in technical results because it is on the contrary the closure means which operate and, thus, which make access passage 6 for the hand in the glove coincide with the forearm of the user.

FIG. 3*a* illustrates, by way of example, one embodiment of the arc according to the invention. An arc 118 made of a flexible material whose shape in cross-section is substantially rectangular is provided. A feature of arc 118 is that it has a preformed substantially circular configuration, i.e., it will enter into the construction of the glove in this shape. Arc 118 is thus biased permanently along F2 and F3 towards its initial position such as is shown in FIG. 3*a*. The distance h between the two free ends 130 and 131 is thus preestablished before the manufacture of the glove.

In contrast to flexible arc 118, FIG. 3*b* illustrates a flexible arc 118' which has a rectangular cross-sectional shape and which has as one feature an initial shape, before construction, that is substantially rectilinear.

Thus, the substantially circular shape that arc 118' has in the active position in glove 1 is given to it during manufacture by insertion of arc 118' in channel 19 of glove 1, while gusset 117 intervenes to limit the extension of arc 118'. This arrangement thus determines the distance h between the two free ends 130' and 131' which exists in the active position of arc 118' in glove 1.

FIG. 3*c* illustrates, by way of example, an embodiment of arc 218 having a circular cross-sectional shape as well as free ends 230 and 231. Arc 218 offers the same characteristic of pre-curvature as arc 118 shown in FIG. 3*a*, In FIG. 3*d* an arc 218' is shown having a circular cross-sectional profile as well as ends 230' and 231'. The flexible arc 218' has the same rectilinear characteristic before manufacture of glove 1 as arc 118' illustrated in FIG. 3*b*.

Elastic arc 18, 118, 118', 218, 218' according to the invention is constituted by a material having elastic properties defining the extent of opening of glove 1, and thus distance h. This distance can have, for example, a size of between about 5 and 20 cm. According to one preferred embodiment, the distance h can be on the order of about 11 cm. One of ordinary skill in the art possesses the ability to select the nature of the elastic material to obtain a given extent of opening of access passage 6 of glove 1.

One can cite, for example, polyamide-type materials, polyethers, "Hytrel", metals, or others.

Figure 4:
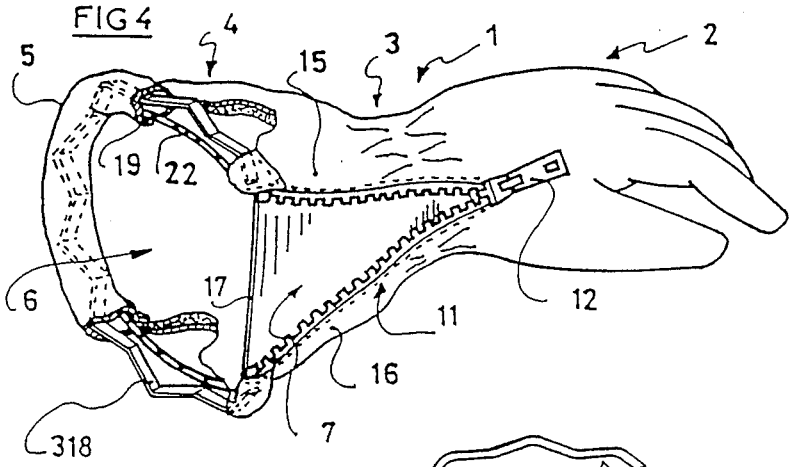
FIG. 4 illustrates a rear perspective view of a second embodiment of the glove according to the invention.
Figure 4A:
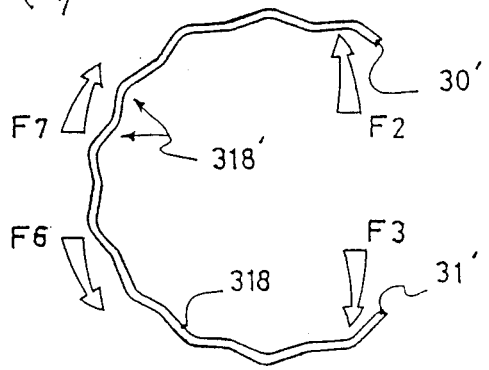
FIG. 4*a* illustrates a rear perspective view of the elastic element according to the second embodiment of the glove according to the invention.

An alternative embodiment is illustrated in FIG. 4. The glove shown in FIG. 4 is similar to that of FIGS. 1 and 2. Also the same reference numerals as used in FIGS. 1 and 2 will be used to designate all of the technical elements. The glove will not be described in detail except to note that:

flexible arc 318 comprises, as shown in FIG. 4*a*, free ends 30' and 31' which are adjacent to the rear limits of edges 15 and 16, respectively, of glove 1.

A feature of this arc 318 is to not present a uniform shape such as, for example, arcs 18, 118, and 218. Instead, arc 318 is constituted by a succession of curves 318' (see FIG. 4*a*) which form an arc 318 of substantially circular shape overall. This configuration of arc 318 offers the advantage of conferring, by virtue of curves 318', a longitudinal elasticity to the arc along F6 and F7. This longitudinal elasticity confers to the arc the ability to extend itself, causing a tension at least one of free ends 30', 31'. When this tension is not being exerted, the arc covers the initial length while at rest. This longitudinal elasticity adds to the transverse elasticity along F2 and F3 which serves as an energy means to enlarge access passage 6 for access of the hand in the non-operational position of closure 11.

The longitudinal elasticity along F6 and F7 acts in the operational position of closure 11. In effect, the tension generated by the closure of glove 1 and the coming together of free ends 30' and 31' results in a flattening of curves 318'. In reaction, these curves will have a tendency, by virtue of the elasticity of the arc material, to come back to their initial rest shapes. This will result in an adjustment of the rear end 5 of glove 1 on the forearm. This adjustment preserves the sealing of glove 1 with respect to the ambient environment.

Figure 5:
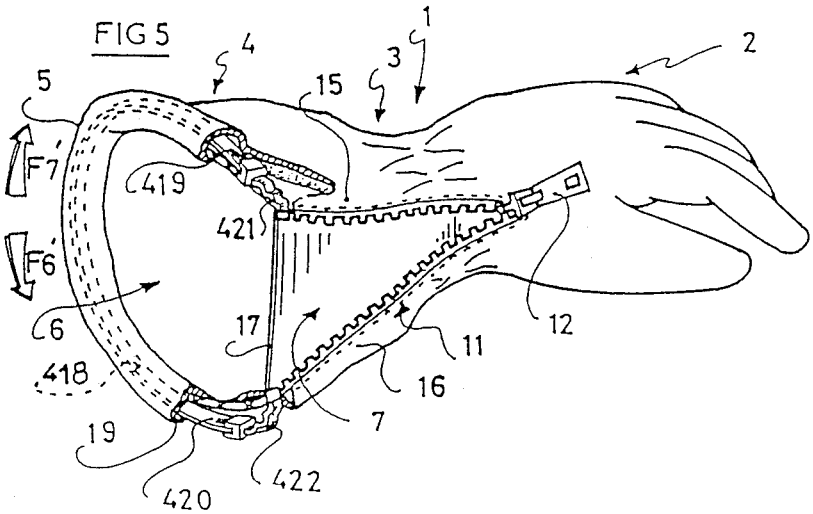
FIG. 5 illustrates a rear perspective view of a third embodiment of a glove according to the invention.

FIG. 5 illustrates an alternative embodiment cf glove 1. This embodiment confers to glove 1, as in the embodiment of FIG. 4, an ability of adjustment of rear end 5 around the forearm in the operational position of closure 11.

The same reference numerals used for FIGS. 1, 2, and 4 will be adopted to designate the elements of the glove of FIG. 5. However, elastic arc 418 has free ends 419, 420, of which at least one is not directly in contact with the rear limit of edges 15 and 16 of opening 7 of glove 1.

There exists at least one flexible elastic element 421 and/or 422 which is affixed to free end 419 and/or 420. The one or more elastic elements 421, 422 are situated in the extension of arc 418 and are affixed to the one or more rear limits of edges 15 and 16 of longitudinal opening 7.

The longitudinal elasticity along F6 and F7 thus conferred to rear end 5 of glove 1 by the one or more elastic elements 421 and/or 422 allows for precise adjustment of rear end 5 around the forearm.

Figure 6:
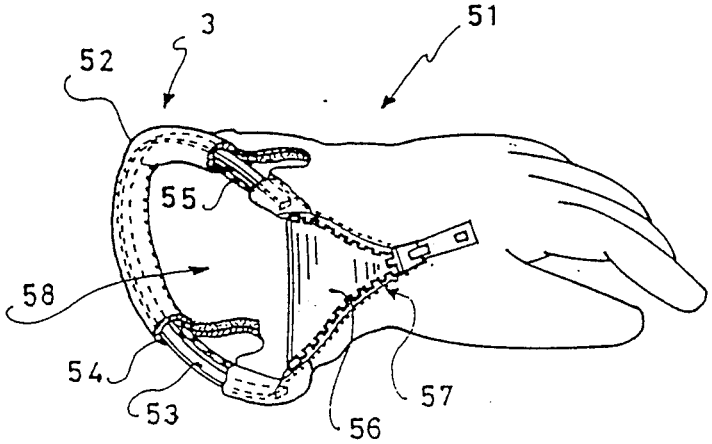
FIG. 6 illustrates a perspective view of another glove model to which the invention is applied.

As is shown in FIG. 6, the apparatus according to the present invention can be applied to a glove 51 which does not possess a cuff and whose rear end 52 is positioned substantially at the level of the user's wrist. Glove 51 has technical elements similar to those described for glove 1 shown in FIGS. 1 and 2.

The elastic arc 53 according to the invention is inserted in channel 54 with a flexible elastic bracelet 55. Glove 51 has an opening 56 which is substantially longitudinal and is equipped with a closure means, particularly a zipper closure 57. Closure 57 is shown in FIG. 6 in the non-operational position, which signifies that elastic arc 53 is in the active maximum opening position of access passage 58 for insertion of the hand in glove 51.

Figure 7:
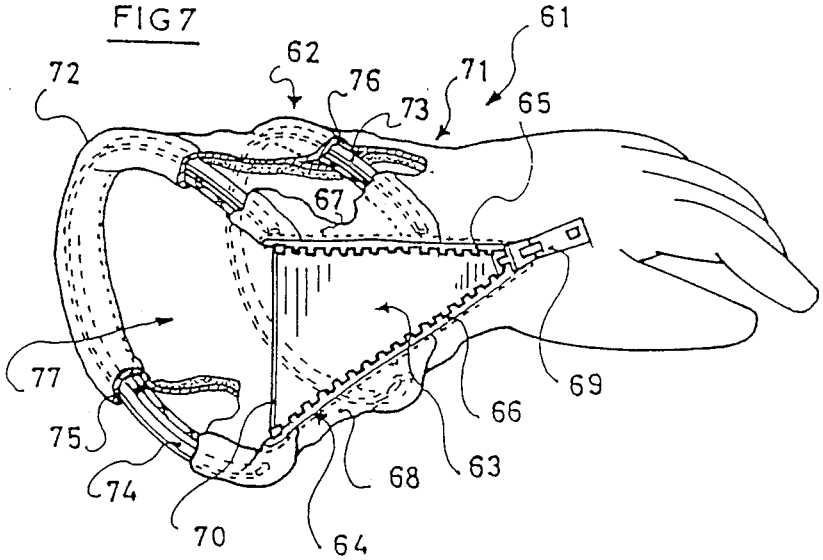
FIG. 7 illustrates a rear perspective view of a fourth embodiment of a glove according to the invention.

FIG. 7 illustrates another embodiment of a glove according to the present invention. The FIG. shows a glove 61 provided with a cuff 62 extending from the zone of wrist 71 to rear end 72, having a substantially longitudinal opening 63, equipped with a zipper closure 64. Opening 63 comprises two portions 65 and 66 which are sewn on edges 67 and 68 of opening 63, as well as a sliding piece 69 which serves to affix the two portions 65 and 66. Opening 63 comprises on the other hand a gusset 70 connected to edges 67 and 68 of opening 63.

Glove 61 differs in that it comprises two flexible arcs 73 and 74. Arc 74 is positioned in channel 75, which is positioned substantially at the rear end 72 of glove 61. Arc 73 is positioned, as is shown by way of example in FIG. 7, in the cuff on a zone extending from the rear end 72 until at least the region 71 of the wrist. Arc 73 is inserted in a channel 76 of glove 61. The arrangement with respect to opening 63 of arc 73 is similar to that of arc 74 which was previously described in FIG. 1. It is furthermore evident that the two arcs 73 and 74 have a difference in size such that the cuff has a substantially truncated conical shape whose major base has as a posterior end perimeter 72. Arc 73 thus has a shorter perimeter than arc 74.

The mode of operation is similar to that which has already been described; the simultaneous action of the two arcs 73 and 74 further increases the size of the opening of the access passage 77 of glove 61 in the non-operational position of closure 63.

Figure 8:
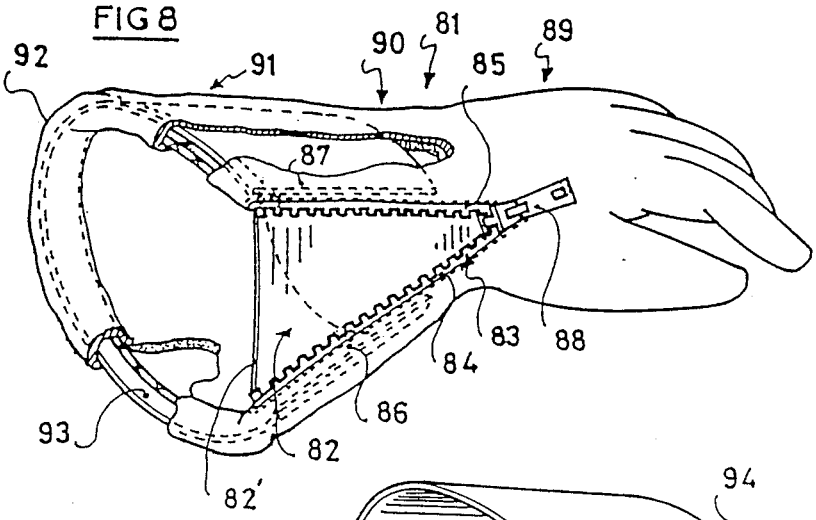
FIG. 8 illustrates a rear perspective view of a fifth embodiment of a glove according to the invention.

In one non-limiting embodiment, illustrated in FIG. 8, glove 81 has largely the same characteristics as glove 1 illustrated in FIG. 1. One finds again a longitudinal opening 82 equipped with a zipper closure 83, the method of closure not being limited to this means which is illustrated only by way of example.

Closure 83 comprises two portions 84 and 85 stitched on edges 86 and 87 of longitudinal opening 82. Closure 83 also comprises sliding piece 88 which serves as a manipulation element to pass from one position to the other, operational and non-operational, of closure 83. A gusset 82' connects the edges of opening 82.

Glove 81 can be subdivided into three main portions. First portion 89 extends substantially from region 90 situated at the level of the wrist to the tip of the user's fingers. The second portion is cuff 91 extending from region 90 to rear end 92 of glove 81. Finally, the third portion is constituted by rear end 92.

Figure 8A:
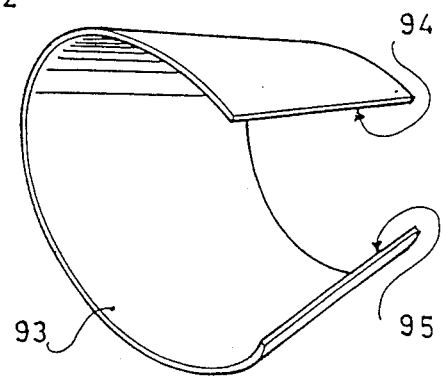
FIG. 8*a* illustrates a rear perspective view of the elastic element according to a fifth embodiment of a glove according to the invention.

One of the characteristics of glove 81 is constituted by the elastic means according to the present invention, namely, a flexible shell 93 inserted in cuff 91. Shell 93 has a transverse cross-sectional shape identical to the arcs 18, 53, 74, 73, 118, and 218 previously described. As can be seen in FIG. 8*a*, shell 93 has free ends 94 and 95 which are adjacent over their entire length to edges 86 and 87 of longitudinal opening 82 of glove 81. Furthermore, shell 93 has a substantially truncated conical shape with the major base situated on the side of rear end 92 of glove 81.

Because the function fulfilled by flexible shell 93 is substantially identical to that of the previously noted arcs, it is unnecessary to repeat this description. However, an additional function of flexible shell 93 is protection of the forearm against shocks. Shell 93 has in effect a relative rigidity and extends along cuff zone 91.

Furthermore, the point previously made with respect to the elastic materials utilized for the elastic means according to the present invention is likewise valid for the flexible shell.

Figure 9:
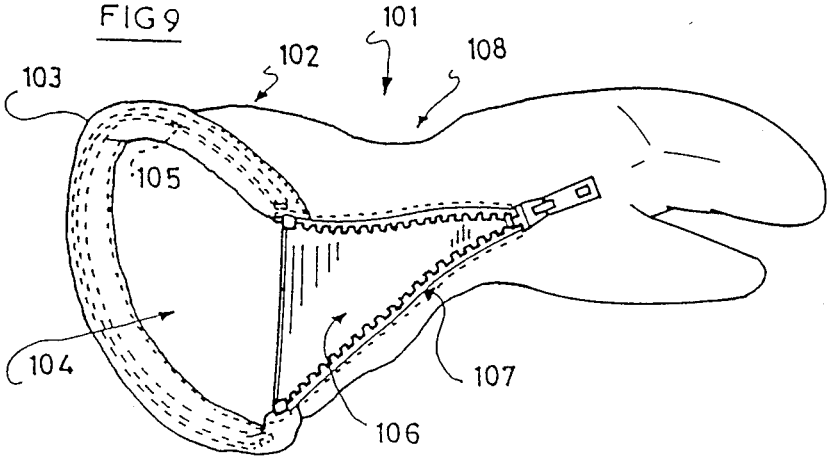
FIG. 9 illustrates a perspective view of a mitten design to which the invention is applied.

FIG. 9 illustrates, by way of example, an article of clothing covering the hand at least until wrist 108, to which one can apply the various previously described embodiments of the invention. A mitten 101 has been shown which comprises a cuff 102, a rear end 103 defining access passage 104 for access of the hand. Mitten 101 comprises, for example, a flexible arc 105 positioned substantially at the rear end 103 of mitten 101, which has a longitudinal opening 106 equipped with a zipper closure 107.

As shown in FIG. 9, the flexible arc 105 allows for the optimum disengagement of passage 104 to permit access of the hand to mitten 101.

It is clear that while FIG. 9 illustrates a mitten, one is in no way limited to this type of clothing. One can in particular cite such an element of clothing comprising independent cavities for the thumb and index finger, with the three remaining fingers being lodged in a single cavity.

FIG. 1*b* illustrates a view of the partial crosssectional according to FIG. 1, with a modification of construction. In order to perfect adjustment of the extreme end of the glove around the forearm in the operational position of the closure means, one can provide for example an elastic flexible bracelet 22 such as is shown in FIG. 1*b*.

This flexible elastic bracelet 22 is positioned in channel 19. It exerts an antagonistic role with respect to flexible arc 18 with, however, a lesser elastic power with respect to arc 18. Elastic bracelet 22 contributes to the improvement of the seal of glove 1 with respect in particular to cold and snow.

For purposes of the present description, the longitudinal opening of the glove according to the present invention has been positioned along an extension of the exterior side of the index finger. It is of course obvious, as is shown in a non-limiting fashion in FIGS. 10*a*, 10*b*, and 10*c*, that the longitudinal opening can be positioned on the top A of glove 1, which may be characterized as a dorsal surface (see FIG. 10*a*); or further along an extension B of the exterior side of the little finger, which may be characterized as a lateral surface (see FIG. 10*b*); or on the bottom C of glove 1, which may be characterized as a ventral surface (see FIG. 10c).

FIG. 11 illustrates another embodiment of flexible arc 18 on glove 1. Instead of being inserted in a channel or an opening constituted in the exterior envelope of the glove, flexible arc 18 is directly sewn with the one or more materials constituting glove 1.

Figure 12:
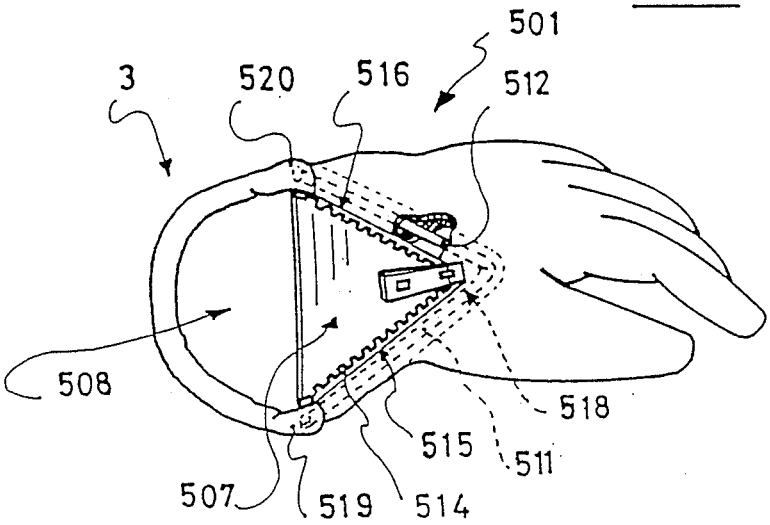
FIG. 12 illustrates a rear view of a sixth embodiment of a glove according to the invention.
Figure 12A:
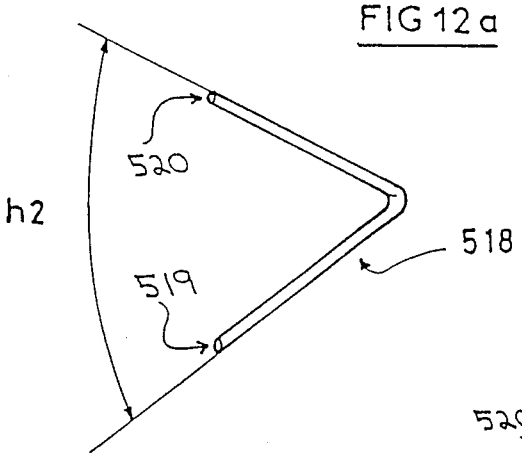
FIGS. 12*a* and 12*b* illustrate the elastic element according to the sixth embodiment in, respectively, the non-operational and operational positions of the closure means of a glove according to the invention.
Figure 12B:
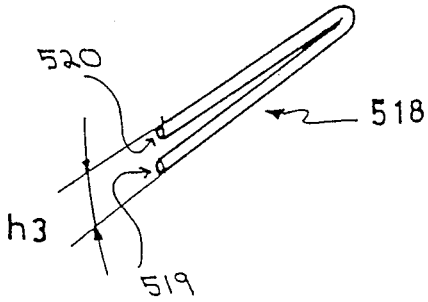

As illustrated in FIGS. 12, 12*a* and 12*b*, the elastic element according to the invention can have the shape of an elastic clip 518. Element 518 has arms 511, 512 encompassing an oblique angle therebetween and comprising free ends 519, 520 which are adjacent to the posterior limits of edges 515 and 516 of longitudinal opening 507.

Element 518 has an elasticity between its arms 511 and 512 which tends to maintain the distance $h_2$ between free ends 519 and 520 at rest, in the equilibrium position. This distance $h_2$, which exists in the non-operational position of closure means 514, determines the maximum opening of access passage 508. In this position, element 518 has substantially the general shape of a "V". In the operational position of closure means 514, the distance existing between the two free ends 519 and 520 is reduced to a minimum value $h_3$ substantially less than $h_2$.

Elastic element 518, which is positioned parallel to edges 515 and 516 of longitudinal opening 507, makes it possible to obtain an access passage 508 for the hand in glove 501 which is substantially open when the glove is being put on.

No further discussion is required concerning the means of attaching the clip 518 to the glove, these means being similar to those described for the elastic elements having a substantially circular shape.

Figure 13A:
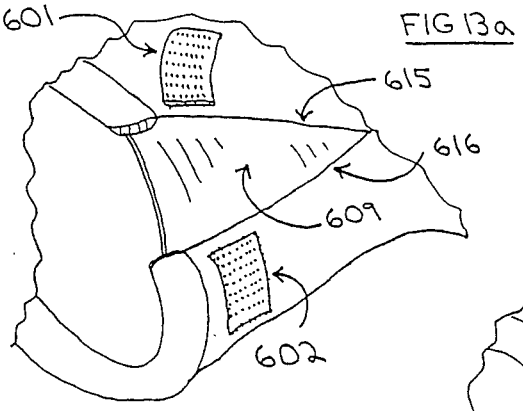
FIGS. 13*a*, 13*b*, 13*c*, and 13*d* illustrate embodiments employing, as non-limiting alternative closure means, Velcro (FIGS. 13*a* and 13*b*), a snap (FIG. 13*c*), and a loop-and-button type closure (FIG. 13*d*).

FIGS. 13*a*, 13*b*, 13*c*, and 13*d* illustrate alternative closure means. FIG. 13*a* shows Velcro tab 601 affixed substantially adjacent edge 615 of longitudinal opening 609. Tab 601 mates with Velcro pad 602 affixed substantially adjacent edge 616 of longitudinal opening 607.

Figure 13B:
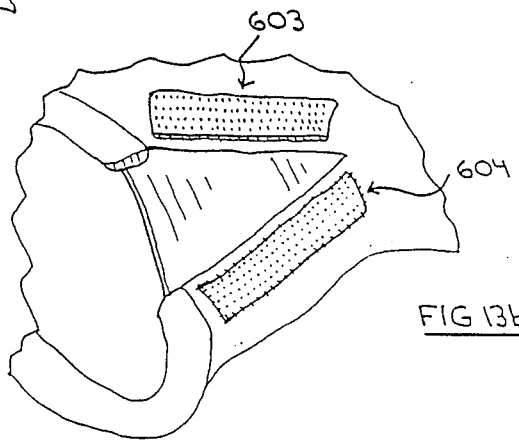

FIG. 13*b* is similar to FIG. 13*a*, except that tab 601 has been replaced with Velcro grip 603, which mates with Velcro strip 604.

Figure 13C:
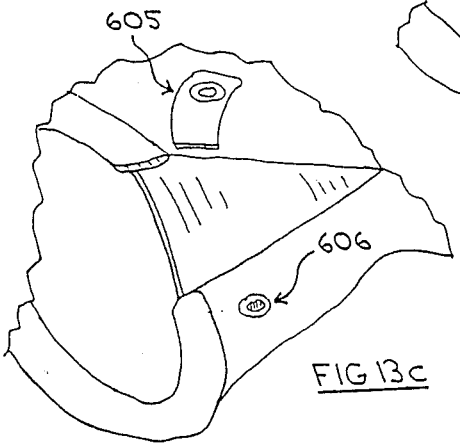

In FIG. 13*c*, the illustrated closure means comprise first snap piece 605, which is pressed into second snap piece 606 to join edges 615 and 616.

Figure 13D:
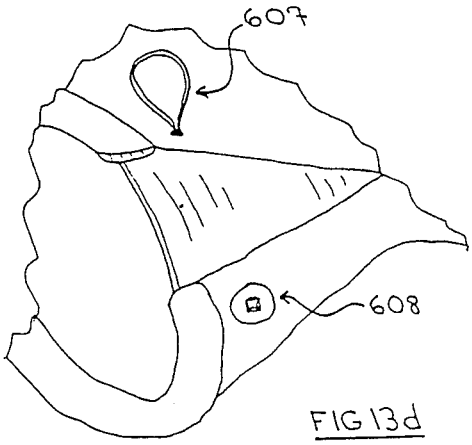

Finally, FIG. 13*d* shows use of loop 607 and button 608 to close longitudinal opening 609.

The placements shown for the various closure elements in FIGS. 13*a–d* are not to be considered limiting, as considerable variation is possible without departing from the scope of the present invention.

Although the invention has been described with reference to particular means, materials, and embodiments, it is to be understood that the invention is not limited to the particulars disclosed and extends to all equivalents within the scope of the claims.

What we claim is:

1. An article of clothing adapted to protect at least a portion of a wearer's body from the ambient environment, said article of clothing comprising:

(a) a rear end comprising an access passage adapted to receive a wearer's hand;

(b) a first elastic member, positioned adjacent said rear end, comprising first biasing means for biasing said access passage into a substantially open position;

(c) closure means for selectively urging said access passage into a substantially closed position in which said hand is substantially sealed from said ambient environment, said closure means comprising means for closing an opening in said article of clothing extending substantially longitudinally forwardly from said rear end, wherein said opening in said article of clothing comprises first and second edges, and wherein said closure means comprises means for selectively joining said first and second edges, wherein said first and second edges comprise first and second edge ends located substantially at said rear end and said first elastic member comprises first and second member ends located substantially adjacent said edge ends, said article of clothing further comprising means for affixing at least one of said member ends to at least one of said edge ends.

2. The article of clothing as defined by claim 1, wherein said means for affixing comprises a flexible elastic element having a first element end which is affixed to one of said member ends and a second element end which is affixed to one of said edge ends.

3. An article of clothing adapted to protect at least a portion of a wearer's body from the ambient environment, said article of clothing comprising:

(a) a rear end comprising an access passage adapted to receive a wearer's hand;

(b) a first elastic member, positioned adjacent said rear end, comprising first biasing means for biasing said access passage into a substantially open position;

(c) closure means for selectively urging said access passage into a substantially closed position in which said hand is substantially sealed from said ambient environment, wherein said access passage comprises a periphery that is substantially circular in said substantially closed position and substantially arcuate in said substantially open position, and further wherein said first elastic member comprises a first elastic band extending along at least a portion of said periphery.

4. The article of clothing as defined by claim 3, wherein said first elastic band is positioned within an enclosed article of clothing channel.

5. The article of clothing as defined by claim 3, wherein said first elastic band has a substantially rectangular cross-section.

6. The article of clothing as defined by claim 3 wherein said first elastic band has a substantially circular cross-section.

7. The article of clothing as defined by claim 3, wherein said first elastic band is substantially linear prior to insertion into said article of clothing and has a substantially circular curvature following insertion of said first elastic band into said article of clothing.

8. The article of clothing as defined by claim 3, wherein said first elastic band has a substantially circular curvature prior to insertion of said first elastic band into said article of clothing.

9. The article of clothing as defined by claim 3, wherein said first elastic band further comprises first and second ends spaced apart by a distance of between about 5 and 20 cm when said access passage is in said substantially open position.

10. The article of clothing as defined by claim 3, wherein said first elastic band is composed of a substance selected from the group consisting of polyamide-type materials, polyethers, Hytrel, and metals.

11. The article of clothing as defined by claim 3, wherein said first elastic band comprises a flexible shell extending longitudinally forwardly from said rear end.

12. The article of clothing as defined by claim 3, wherein said first elastic band has a generally curvilinear shape comprising a plurality of sections that are oppositely angled with respect to each other when said access passage is in said substantially open position, said first elastic band being urged into a substantially continuous curve when said access passage is in said substantially closed position.

13. The article of clothing as defined by claim 3, further comprising a second elastic band extending transversely along at least a portion of said article of clothing at a location spaced apart from said first elastic band, said second elastic band comprising second biasing means for biasing said access passage towards said substantially open position.

14. The article of clothing as defined by claim 13, wherein each of said first and second elastic bands is positioned within an enclosed channel of said article of clothing.

15. The article of clothing as defined by claim 13, further comprising a cuff portion, a wrist portion, and a hand portion, said cuff portion extending from said rear end forwardly towards said wrist portion, said wrist portion extending from said cuff portion forwardly to said hand portion, and said hand portion extending forwardly from said wrist portion to a front end, wherein said second elastic band is located substantially along said wrist portion.

16. The article of clothing as defined by claim 13, wherein said second elastic band is shorter than said first elastic band.

17. The article of clothing as defined by claim 13, further comprising a third elastic band extending substantially both parallel to and adjacent said first elastic band, said third elastic band comprising third biasing means for biasing said access passage towards said substantially closed position with a lesser biasing force than said first elastic member.

18. The article of clothing as defined by claim 17, wherein said first and third elastic bands are enclosed within a single channel of said article of clothing.

19. The article of clothing as defined by claim 3, wherein said article of clothing comprises a mitten.

20. The article of clothing as defined by claim 19, wherein said article of clothing comprises a first cavity adapted to receive a thumb and a second cavity adapted to receive the remaining digits of said hand.

21. The article of clothing as defined by claim 3, wherein said article of clothing comprises a glove.

22. The article of clothing as defined by claim 21, wherein said article of clothing comprises a plurality of cavities each adapted to receive one digit.

23. The article of clothing as defined by claim 21, wherein said article of clothing comprises a first cavity adapted to receive a thumb, a second cavity adapted to receive an index finger, and a third cavity adapted to receive a middle, ring, and index finger.

24. The article of clothing as defined by claim 3, wherein said access passage has a first open area in said substantially open position and a second open area in said substantially closed position, wherein said first open area is greater than said second open area.

25. The article of clothing as defined by claim 24, wherein said first open area is defined by a periphery which is at least substantially equal to the periphery of the forbear of said wearer.

26. An article of clothing adapted to cover a portion of the hand of a wearer extending from the fingers to at least the wrist area of said wearer, waid article of clothing comprising an access passage adapted to receive said hand, elastic means for biasing said access passage into a substantially open position, and closure means for selectively urging said access passage into a substantially closed position, wherein said closure means are movable between a nonoperational position and an operational position and, further, wherein said access passage has a cross-sectional area greater than the cross-sectional area of said wrist area when said closure means are in said non-operational position.

27. The article of clothing as defined by claim 26, further comprising a rear end and a wrist zone, wherein said elastic means comprise an elastic element comprising at least one flexible arc positioned substantially between said rear end and said wrist zone.

28. The article of clothing as defined by claim 26, wherein said article of clothing is adapted to cover a portion of said user's hand extending from said user's finger to substantially said user's wrist area.

29. The article of clothing as defined by claim 26, further comprising a cuff portion adapted to cover a portion of said user's hand extending from said user's wrist area rearwardly towards said user's forearm area.

30. The article of clothing as defined by claim 26, wherein said elastic means comprise an elastic element constituted by a flexible arc, and further wherein said flexible arc is enclosed in an article of clothing channel bordering said access passage.

31. The article of clothing as defined by claim 26, further comprising an elastic element comprising at least one flexible arc positioned in at least one article of clothing channel.

32. The article of clothing as defined by claim 26, further comprising an opening positioned substantially longitudinally along said article of clothing and comprising first and second edges, wherein said elastic means comprise a substantially V-shaped elastic element comprising two arms, each of said arms being positioned parallel to one of said edges.

33. The article of clothing as defined by claim 26, wherein said closure means comprises a zipper.

34. The article of clothing as defined by claim 26, wherein said closure means comprises Velcro.

35. The article of clothing as defined by 26, wherein said closure means comprises a pressure button type closure.

36. The article of clothing as defined by claim 26 said article of clothing further comprising a glove or mitten wherein said access passage comprises a first lateral side comprising a thumb enclosure, a dorsal side adjacent said first lateral side, a second lateral side adjacent said dorsal side, and a ventral side adjacent both said second lateral side and said first lateral side.

37. The article of clothing as defined by claim 36, wherein said opening is positioned substantially in said first lateral side.

38. The article of clothing as defined by claim 36, wherein said opening is positioned substantially in said dorsal side.

39. The article of clothing as defined by claim 36, wherein said opening is positioned substantially in said second lateral side.

40. The article of clothing as defined by claim 36, wherein said opening is positioned substantially in said ventral side.

41. The article of clothing as defined by claim 26, further comprising an opening positioned substantially longitudinally along said article of clothing and having an open position corresponding to said non-operational position and a closed position corresponding to said operational position.

42. The article of clothing as defined by claim 41, wherein said elastic means comprise an elastic element having substantially circular curvature and comprising two free ends separated by a distance h when said closure means are in said non-operational position and by a distance $h_1$ when said closure means are in said operational position, said distance h being greater than said distance $h_1$.

43. The article of clothing as defined by claim 42, further comprising first and second edges of said opening and at least one additional elastic element affixed to at least one of said first and second edges, wherein at least one of said two free ends of said elastic element is affixed to said at least one additional elastic element.

44. The article of clothing as defined by claim 42, wherein said elastic element comprises a shell extending forwardly from the opening of said access passage.

45. The article of clothing as defined by claim 42 substantially in the form of a mitten, further comprising first and second edges of said opening and a gusset sealing said opening, wherein the dimensions of said gusset correspond to said distance h.

46. The article of clothing as defined by claim 42, wherein said elastic element comprises a flexible arc positioned substantially around said access passage to provide access for said hand.

47. The article of clothing as defined by claim 46, wherein said flexible arc has a substantially circular cross-section.

48. The article of clothing as defined by claim 46, wherein said flexible arc has a substantially rectangular cross-section.

49. The article of clothing as defined by claim 46, wherein said flexible arc has a pre-curved shape which establishes the maximum diameter of said access passage.

50. The article of clothing as defined by claim 46, wherein said flexible arc has a substantially rectilinear shape prior to insertion into said article of clothing.

51. The article of clothing as defined by claim 46, wherein said flexible arc comprises a plurality of oppositely-angled curves.

52. The article of clothing as defined by claim 26, wherein said cross-sectional area of said access passage in said non-operational position is greater than said cross-sectional area of said access passage in said operational area.

53. The article of clothing as defined by claim 52, wherein said cross-sectional area of said access passage in said non-operational position is defined by a periphery which is at least substantially equal to the periphery of the forearm of said wearer.

54. An article of clothing adapted to cover a portion of the hand of a wearer extending from the fingers to at least the wrist area of said wearer, said article of clothing comprising an access passage adapted to receive said hand, elastic means for biasing said access passage into a substantially open position, and closure means for selectively urging said access passage into a substantially closed position, wherein said elastic means comprise an elastic element comprising a flexible arc affixed to at least one layer of material used to form said article of clothing.

* * * * *

UNITED STATES PATENT AND TRADEMARK OFFICE

CERTIFICATE OF CORRECTION

PATENT NO. : 4,868,927

DATED : Sep. 26, 1989

INVENTOR(S) : Joel BOURDEAU et al.

It is certified that error appears in the above-identified patent and that said Letters Patent is hereby corrected as shown below:

Column 2, line 34, change "my" to ——may——.

Column 3, line 6, change "substances" to ——substance——.

Column 4, line 33, insert ——may—— after "clothing".

Column 14, line 41, change "claim 13" to ——claim 3——.

Column 15, line 7, change "forbear" to ——forearm——; and

Column 15, line 16, change "nonoperational" to ——non-operational——.

Signed and Sealed this

Fifteenth Day of October, 1991

*Attest:*

*Attesting Officer*

HARRY F. MANBECK, JR.

*Commissioner of Patents and Trademarks*